US005303855A

United States Patent [19]

Veale

[11] Patent Number: 5,303,855

[45] Date of Patent: Apr. 19, 1994

[54] HAIR ACCESSORY MODULAR ORGANIZER

[76] Inventor: Jane E. Veale, 43 Captains Dr., Alameda, Calif. 94501

[21] Appl. No.: 81,104

[22] Filed: Jun. 25, 1993

[51] Int. Cl.[5] ..... A47G 25/18

[52] U.S. Cl. ..... 223/85; 223/88

[58] Field of Search ..... 223/85, 88, 92, 95, 223/DIG. 1; 211/113; D6/315; 206/278, 290

[56] References Cited

U.S. PATENT DOCUMENTS

| | | | |
|---|---|---|---|
| 2,058,217 | 10/1936 | Dixon . | |
| 2,127,870 | 8/1938 | Kennedy | 223/88 |
| 2,365,655 | 12/1944 | Young et al. | 223/88 |
| 2,641,392 | 6/1953 | Smith | 223/88 |
| 3,194,457 | 7/1965 | Freilich . | |
| 3,452,881 | 7/1969 | Jamison | 223/85 |
| 4,034,865 | 7/1977 | Batts et al. . | |
| 4,778,088 | 10/1988 | Miller . | |
| 4,871,098 | 10/1989 | Bredeweg et al. . | |
| 4,872,568 | 10/1989 | Lehmann . | |
| 5,029,739 | 7/1991 | Blanchard et al. . | |
| 5,074,446 | 12/1991 | Suddath | 223/85 |
| 5,161,720 | 11/1992 | Kolton et al. . | |

FOREIGN PATENT DOCUMENTS

| | | | |
|---|---|---|---|
| 572132 | 9/1944 | United Kingdom | 223/88 |

*Primary Examiner*—Clifford D. Crowder
*Assistant Examiner*—Bibhu Mohanty
*Attorney, Agent, or Firm*—Richard C. Litman

[57] ABSTRACT

A hanging support for head bands, barrettes, and the like. The support has a hook in the manner of a coat hanger, and a horizontal rack bar snap fastens thereto. The rack bar has snap fasteners enabling attachment of additional rack bars. The rack bars have any one of three configurations, and may be selectively combined to form a semi-custom hanging support. The three configurations include straight tube, for attaching hair accessories having clips; spiralled, for draping molded plastic head bands thereon; and wire formed in the shape as horns, for encircling retention of closed loop resilient or flexible hair bands. Extension bars are optionally provided to increase spacing between adjacent rack bars. The constituent parts of the hanging support have similar cross sectional configuration, so that any combination of parts gives the impression of unitary appearance.

6 Claims, 2 Drawing Sheets

HAIR ACCESSORY MODULAR ORGANIZER

BACKGROUND OF THE INVENTION

1. Field of the Invention

The present invention relates to a modular hanging rack for supporting a variety of hair accessories which are worn in the manner of garments, such as head bands.

2. Description of the Prior Art

Hanging racks have been the subject of prior art patents. A tie rack having plural, parallel bars for supporting ties is seen in U.S. Pat. No. 2,058,217, issued to Herbert W. Dixon on Oct. 20, 1936. U.S. Pat. No. 4,778,088, issued to Anne Miller on Oct. 18, 1988, discloses a hanging garment carrier wherein the garment engaging members are arranged to extend vertically, there being several parallel such members.

A plurality of vertically oriented article carriers is shown in U.S. Pat. No. 4,034,865, issued to John H. Batts et al. on Jul. 12, 1977. Additional carriers may be stacked in cascading fashion by hooking a new carrier to the end of a similar carrier previously attached to and depending from an upper carrier.

Similar cascading arrangements of ordinary clothes hangers are disclosed in U.S. Pat. Nos. 4,871,098, issued to Robert A. Bredeweg et al. on Oct. 3, 1989; 4,872,568, issued to Ernest Lehmann on Oct. 10, 1989; and 5,029,739, issued to Russell O. Blanchard et al. on Jul. 9, 1991.

Construction of a horizontal bar of a hanger for engaging a draped garment thereon is seen in U.S. Pat. Nos. 3,194,457, issued to Sanford Jerome Freilich on Jul. 13, 1965, and 5,161,720, issued to Chester Kolton et al. on Nov. 10, 1992. Freilich provides a spiral member defining peaks and valleys; Kolton et al. provides, an essentially planar bar having peaks molded therein.

None of the above inventions and patents, taken either singly or in combination, is seen to describe the instant invention as claimed.

SUMMARY OF THE INVENTION

The present invention provides a practical and aesthetically pleasing hanging support for storing and organizing headwear, such as bands, barrettes, and similar adornments which are worn on the hair in the manner of garments. The hanger includes a hook which enables hanging from closet rods, hooks fastened to doors and walls, and similar fasteners.

An accessory supporting horizontal bars is snap fit to the hook member, and additional support bars are progressively added. Any number of bars may be attached, and include at least three distinct styles. A first style is a straight rod or the like for attachment of hair accessories having clips. A second style is a spirally wound rod, or a member including a sawtooth profile, for. draping rigid head bands thereon. For flexible, closed loop accessories incapable of maintaining shape, a support bar is provided having a rod formed in the manner of a horn, the closed loop accessory being placed over the horn, and thus is retained by encirclement.

The elongated body members of the hook member and all supporting bars are of similar cross sectional configuration. The snap fit joints are configured to produce a close fit between adjacent members, with a joint gap so narrow as not to entrap a fabric. The resultant hanging support thus has a pleasing, unitary appearance, even though it is made up of plural sections, and garments, hair accessories, and other fabric articles will not snag thereon.

Each support bar holds a number of similar hair accessories, so that similar accessories are stored and grouped by type. Vertical spacing between adjacent support bars is varied by including optional extensions.

Accordingly, it is a principal object of the invention to provide a hair accessory hanging supporter which is of manually assembled and disassembled, modular construction.

It is another object of the invention to provide a hair accessory hanging supporter which presents a unitary appearance regardless of the number of modules actually assembled thereto.

It is a further object of the invention to provide a hair accessory hanging supporter having plural, horizontal support bars, each support bar having means to support a plurality of similar hair accessories, whereby hair accessories of different types are supported and grouped according to type.

Still another object of the invention is to provide a hair accessory hanging supporter wherein a dimension of vertical separation between adjacent horizontal support bars is selectively varied.

An additional object of the invention is to provide a hair accessory hanging supporter suitable for ready retention of flexible, closed loop hair accessories, hair accessories having clips, and hair accessories capable of retaining a shape.

It is an object of the invention to provide improved elements and arrangements thereof in an apparatus for the purposes described which is inexpensive, dependable and fully effective in accomplishing its intended purposes.

These and other objects of the present invention will become, readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
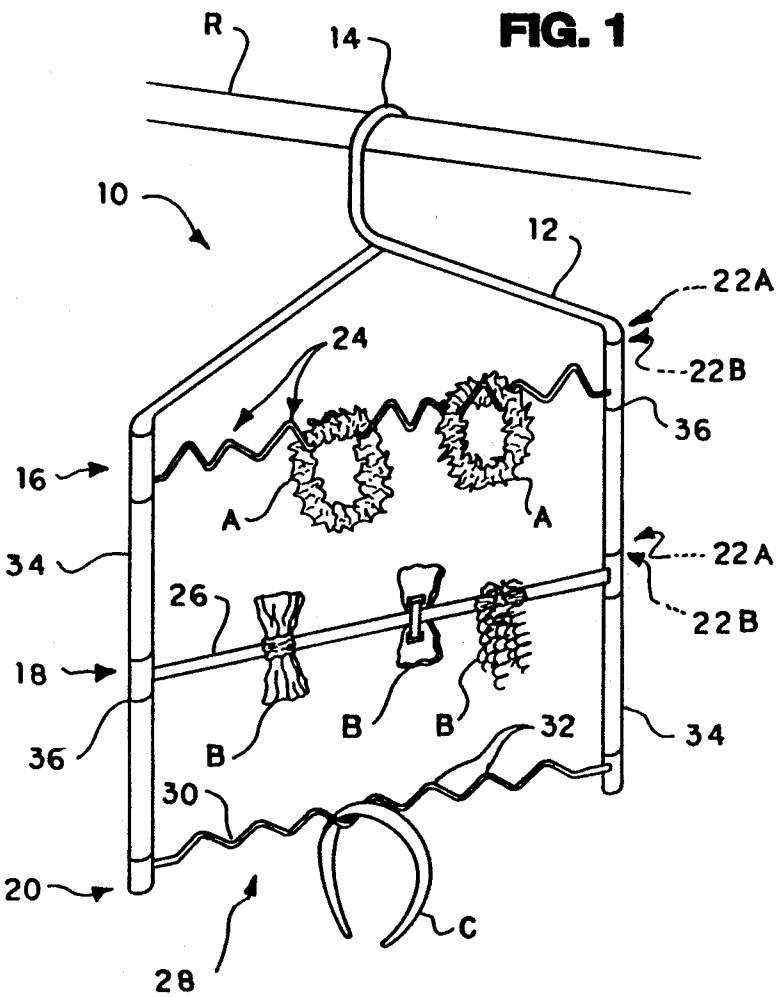
FIG. 1 is an environmental perspective view of the invention.

The present invention provides a snap fit, modular hanging support 10 for various garment type hair accessories, as seen in FIG. 1. An uppermost modular section 12 includes a hook 14, for hanging on a closet rod R, wall hook or eye (not shown), or similar household attachment.

Figure 2:
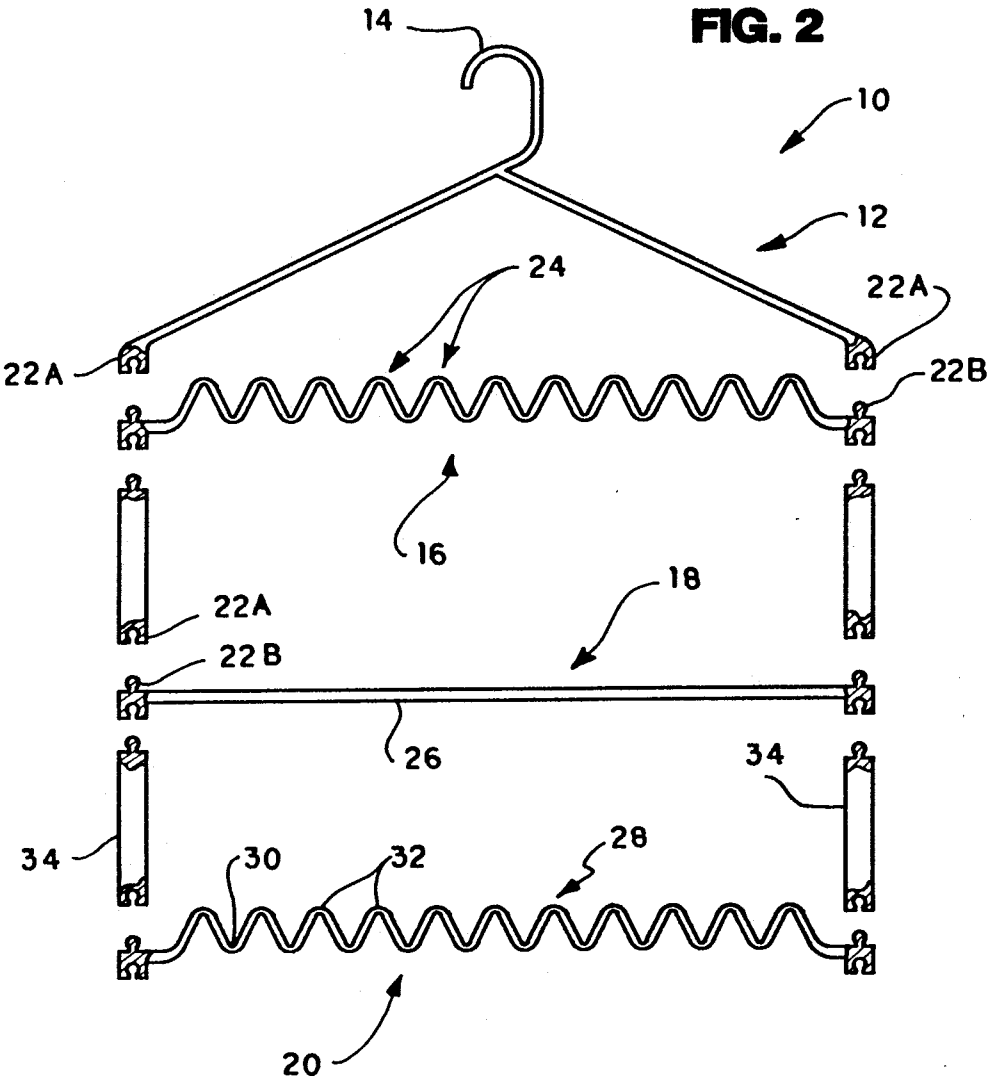
FIG. 2 is an exploded, front elevational view of the invention, shown partially in cross section.
Figure 3:
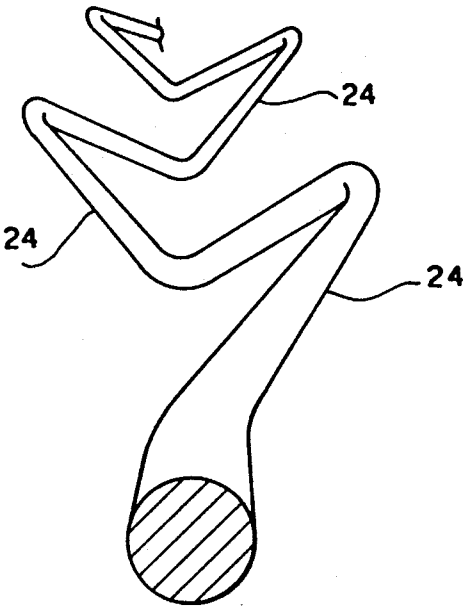
FIG. 3 is a perspective detail view of one style of horizontal accessory support bar.

Individual modules 12,16,18,20 are shown in FIG. 2. Uppermost of the modules is hook modular section 12, having hook 14 and female snap fit connectors 22A. The next lower module illustrated is a support bar 16 for providing encircling retention of closed loop type bands A (see FIG. 1), and comprises a rod formed to resemble a succession of inverted "V" FIGS. 24 having rounded points. Support bar modules 16, 18 and 20 also include two female connectors 22A and two male connectors 22B. Referring to FIG. 3, each succeeding inverted "V" FIG. 24 is inclined alternately forwardly or backwardly so as to separate adjacent hair accessories A,A to a maximal extent, while still providing maximal storage 1 positions on the module.

Returning to FIG. 2, a third type of module, or support bar 18, comprises a straight, linear rod or strip 26. This support bar 18 is used for holding hair accessories B having clips, so that the accessory B need only be clipped to straight, linear rod or strip 26 .

The remaining support bar 20 includes a sawtooth profile 28. This profile 28 could be provided by either a sawtooth configuration or by a spirally wound rod (not shown). The "rod" just referred to is intended to encompass stock material which is straight. A molded headband C (see FIG. 1) or similar accessory capable of holding a shape seats in a valley 30 formed between adjacent peaks 32 of sawtooth profile 28.

It will be noted that extensions 34 space apart adjacent support bars 16,18, or 20. The number of extensions 34 installed is a matter of the user's choice. Extensions 34 may be made different lengths, so that the user is able to configure the final assembled hanging support 10 as desired.

Figure 4:
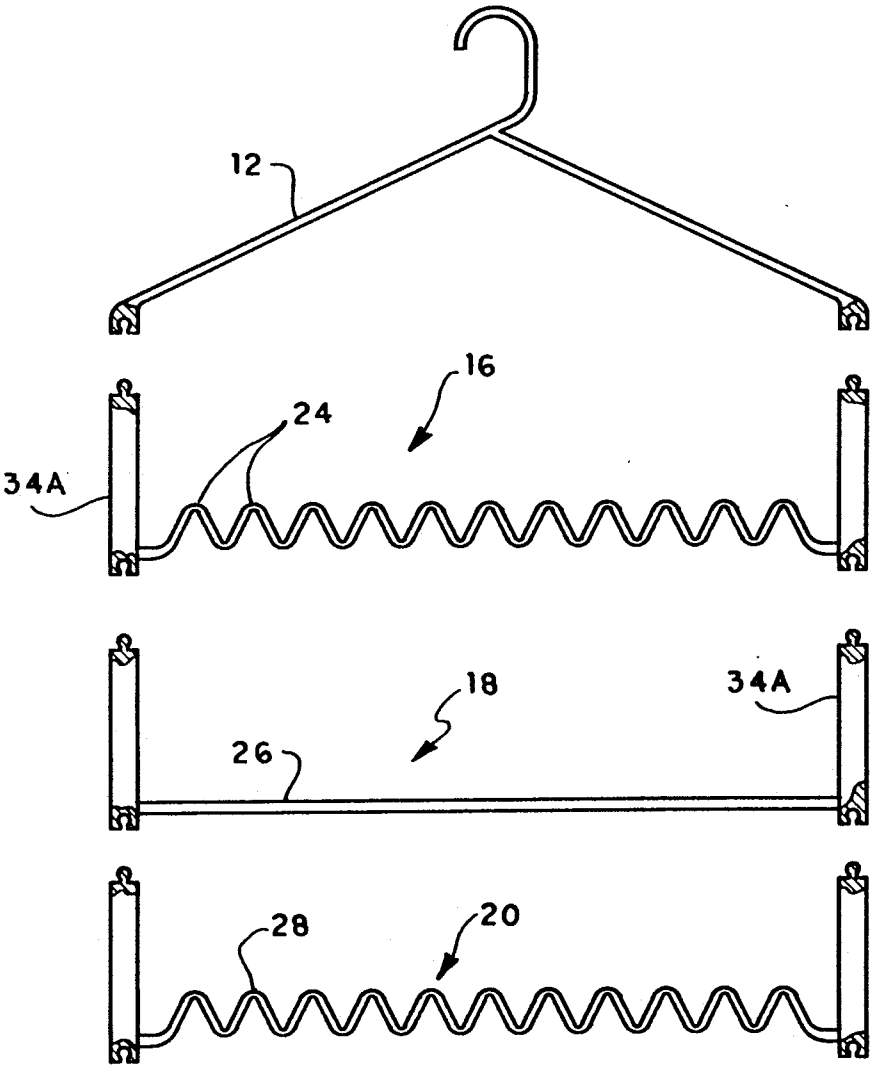
FIG. 4 is an exploded, front elevational view of a second embodiment of the invention, shown partially in cross section.

As will be seen in FIG. 4, it is also possible to form extensions 34A integrally with a support bar 16,18, or 20, if it is desired to eliminate separate extensions 34.

The cross sectional configuration of each connector 22A or 22B and extension 34 or 34A is identical, and connectors 22A or 22B are formed to enable virtually seamless joints 36 (see FIG. 1). Thus, the assembled hanging support 10 has a pleasing appearance of unitary construction, and seamless joints 36 are unable to pinch and snag a fabric (not shown) which might come into incidental contact therewith.

Attachment of modules is preferably provided by female and male snap fit connectors 22A, 22B. Each modular support bar 16, 18, or 20 has upwardly facing male connectors 22B and downwardly facing female connectors 22A. Of course, it would be equally effective to reverse the orientation of the female and male connection members 22A and 22B. However, it is important to provide a male connector 22B at all connection points oriented in the same direction, and a female connector 22A at all connection points oriented in the opposite direction, so that any one modular support bar 16, 18, or 20 can be progressively attached to the previously installed support bar 16, 18, or 20. The same arrangement regarding polarity of connectors 22A and 22B holds true for extensions 34, where employed.

It is to be understood that the present invention is not limited to the embodiments described above, but encompasses any and all embodiments within the scope of the following claims.

I claim:

1. A modular organizer comprising:

a hook member having a hook for supporting said organizer by hanging, and manually attachable and detachable frictional connection means for connecting at least one accessory supporting member thereto; and a plurality of accessory supporting members vertically spaced apart from one another at predetermined separation dimensions, said plurality of accessory supporting members including:

at least one first accessory supporting member having a first accessory holder comprising a horizontally extending succession of projections inclined to lean alternately forwardly and backwardly, and having frictional connection means configured, dimensioned, and aligned to mate with other said frictional connection means;

at least one second accessory supporting member having a second accessory holder comprising a horizontally disposed linear member and having frictional connection means configured, dimensioned, and aligned to mate selectively with other said frictional connection means; and at least one third accessory supporting member having a third accessory holder comprising a horizontally extend in succession of vertically extending projections having rounded ends, and having frictional connection means configured, dimensioned, and aligned to mate selectively with other said frictional connection means.

2. The modular organizer according to claim 1, each of said frictional connection means being configured to present a continuous and uninterrupted appearance at a joint between adjacent corresponding frictional connection means when mutually connected.

3. The modular organizer according to claim 1, said frictional connection means being configured to present joints unencumbered by projections and to form gaps sufficiently narrow to avoid snagging a fabric therein.

4. The modular organizer according to claim 1, wherein said frictional connection means each comprise a male connector and a female connector, one of said male and female connectors facing upwardly, and the other of said male and female connectors facing downwardly, wherein all male connectors face in one of said upward and downward directions, and all female connectors face in the other of said upward and downward directions.

5. The modular organizer according to claim 4, further including at least one extension selectively spacing apart one of said male connectors and said female connectors from a corresponding connector of an adjacent said accessory holder.

6. The modular organizer according to claim 5, each said extension having an elongated body of similar cross sectional configuration as said frictional connection means, whereby the cross sectional configuration of said organizer is maintained constant when attaching accessory holders and extensions thereto, and upper and lower frictional connection means aligned and cooperating with, attachable to, and detachable from other said frictional connection means, whereby any one of said separation dimensions is selectively variable.

* * * * *